United States Patent [19]

Petter et al.

[11] Patent Number: 4,690,587

[45] Date of Patent: Sep. 1, 1987

[54] CORROSION DETECTION FOR MARINE STRUCTURE

[75] Inventors: Karl H. Petter, Metairie; Gregory K. Robbins, Mandeveille, both of La.

[73] Assignee: Texaco Inc., White Plains, N.Y.

[21] Appl. No.: 789,545

[22] Filed: Oct. 21, 1985

[51] Int. Cl.[4] ..... C23F 13/00

[52] U.S. Cl. ..... 405/211; 204/197; 204/286

[58] Field of Search ..... 405/24; 204/196, 197, 204/286

[56] References Cited

U.S. PATENT DOCUMENTS

| | | | |
|---|---|---|---|
| 3,649,492 | 3/1972 | Marsh et al. | 204/196 |
| 3,699,689 | 10/1972 | Haynes | 405/211 |
| 3,769,521 | 10/1973 | Caldwell et al. | 405/211 |
| 3,855,102 | 12/1974 | Palmer | 204/196 |
| 3,954,591 | 5/1976 | Conkling | 204/196 |
| 4,056,446 | 11/1977 | Vennett | 204/197 |
| 4,089,767 | 5/1978 | Sabins | 405/211 |
| 4,251,343 | 2/1981 | Peterson | 204/197 |
| 4,318,787 | 3/1982 | Peterson et al. | 204/197 |
| 4,484,839 | 11/1984 | Nandlal et al. | 204/197 |
| 4,544,465 | 10/1985 | Marsh | 204/197 |
| 4,609,448 | 9/1986 | Robbins | 204/197 |

*Primary Examiner*—Richard J. Scanlan, Jr.
*Assistant Examiner*—Eric K. Nicholson
*Attorney, Agent, or Firm*—Robert A. Kulason; James J. O'Loughlin; Robert B. Burns

[57] ABSTRACT

In a corrosion monitoring system for an offshore marine platform which includes a deck positioned above the water's surface and a jacket fixed to the ocean floor to support said deck, said monitoring system including cable means extending from the deck to the ocean floor and carrying corrosion monitoring instruments for generating an electrical signal, said carriage being fabricated of such a material to allow generation of said electrical signals without interference or distortion of the latter.

9 Claims, 5 Drawing Figures

CORROSION DETECTION FOR MARINE STRUCTURE

BACKGROUND OF THE INVENTION

Any metallic structure which is positioned in an offshore salt water environment, will, after a period of time, be subjected to progressive corrosion and deterioration of exposed metallic parts. One way to prevent or at least deter such corrosive action is through the use of coatings such as paints and anti-corrosion systems which are capable of counteracting the deleterious effects. It has been found desirable for example to provide submerged parts of the structure with a series of sacrificial anodes. Thus, rather than the structure's metallic parts deteriorating under the cathodic effects of corrosive action, the sacrificial anodes will progressively deteriorate.

This method of corrosion control is widely practiced by the petroleum industry. Offshore drilling and producing structures frequently utilize sacrificial anodes in their prevention systems.

To monitor the degree of protection for the structure, these sacrificial anodes must be periodically surveyed. Normally, offshore structures are subjected to scheduled inspections usually by divers who descend with the necessary instrumentation to both test and observe the degree of protection afforded by the many sacrificial anodes. In relatively shallow water, the use of divers is practical and entails minimal expense. Notably, the water depth will be a primary expense factor.

The present generation of offshore structures of the type contemplated is often made for use in water depths on the order of magnitude of 1,000 feet and greater. It can be appreciated therefore that for such a structure, the use of divers to periodically descend and check the anti-corrosion system can be an expensive as well as a dangerous operation.

The prior art has dealt with the subject of cathodic protection and monitoring equipment therefor. U.S. Pat. No. 4,056,446, for example, teaches the use of an instrument package which is guidably raised and lowered through the steel members of an offshore structure to gather the necessary data. This arrangement, however, embodies limitations which restrict its utility. In U.S. Pat. No. 4,609,448, patented Sept. 2, 1986, an improved system is disclosed for readily monitoring a segment of an offshore submerged structure.

Toward simplifying the monitoring and inspection process for relatively tall or deep water structures, the present invention provides a further improved means whereby the cathodic protection system can be more accurately monitored. Further, it can be achieved without the use of divers and by a relatively simple apparatus incorporated into the structure.

The apparatus comprises primarily a package or combination of electronically sensitive monitoring instruments and ancillary equipment. The entire unit is capable of being raised and lowered on an instrument carriage which slides along guide cables. Cable means communicates the package with surface equipment to remotely record the obtained readings.

It is therefore an object of the invention to provide a cathodic protection monitor system for a structure positioned in an offshore body of water.

A further object is to provide a corrosion detecting monitor system which is operated and controlled from a structure's deck whereby to minimize or avoid the use of divers A still further object is to provide a corrosion detection system including a mobile, instrument-carrying carriage that will not interfere with accurate electronic readings.

DESCRIPTION OF THE DRAWINGS

Referring to FIG. 1, an offshore structure 10 of the type contemplated is comprised normally of an elongated jacket which extends from the water's surface 11 down to the floor 12 of the body of water. The upper end of the jacket protrudes beyond surface 11 and is adapted to receive a working deck 13 on which the normal operating equipment is carried. In the instance of an offshore drilling platform, such equipment, although not shown, would include the usual derrick, together with facilities for storing equipment and personnel normally utilized for drilling wells into the ocean floor.

The platform jacket is comprised primarily of a plurality of substantially vertical support legs 14 and 16. The latter are formed of steel cylindrical members which are welded and mutually joined by a series of horizontal braces 19 as well as by intermediary bracing struts 18.

Jackets of this type are normally fabricated of welded steel tubulars, and usually coated with a surface material to deter the corrosive effect of salt water for a limited period.

Figure 1:
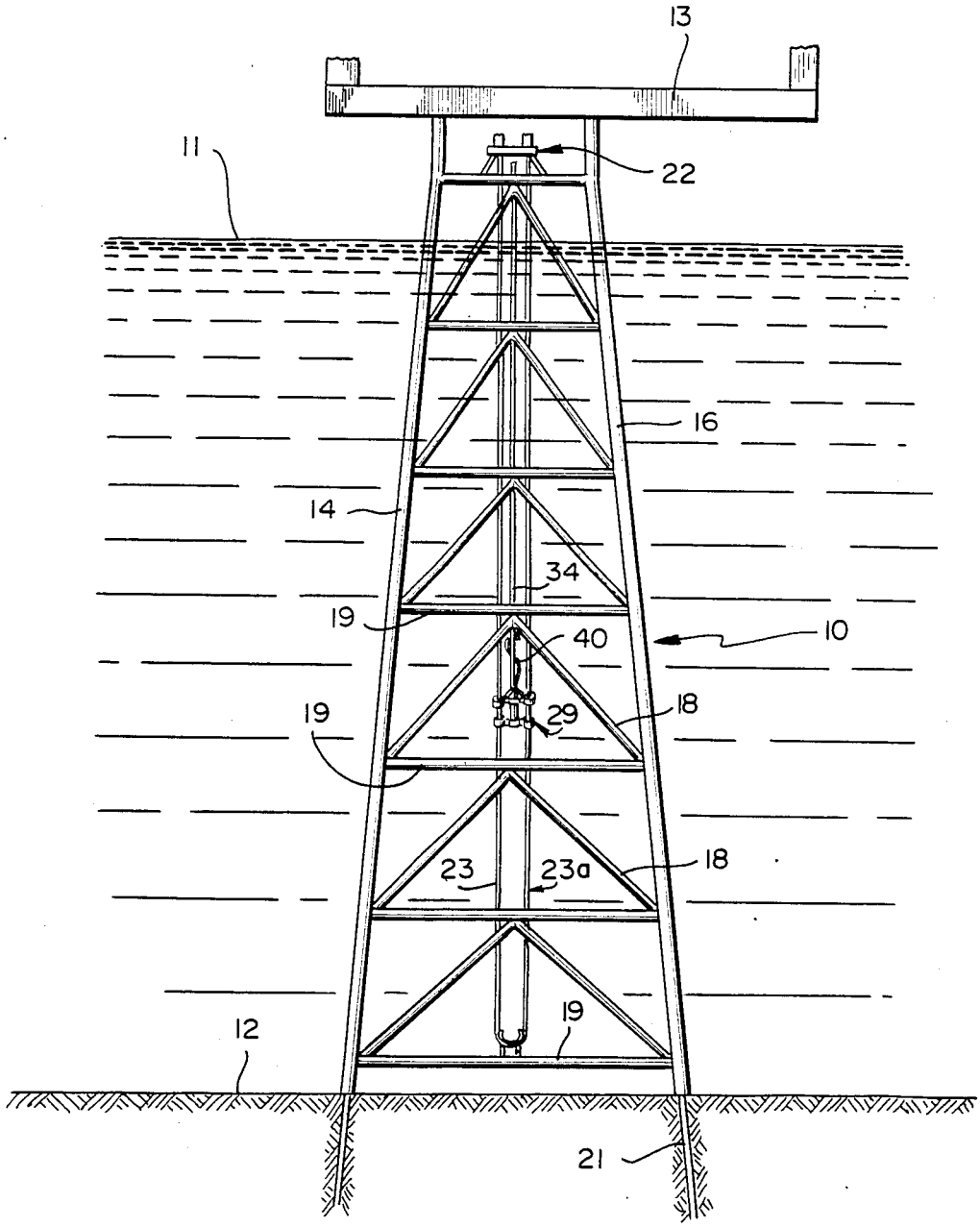
FIG. 1 is an elevation view of a marine structure of the type contemplated which embodies a cathodic protection monitor system.

The jacket shown in FIG. 1 includes a lower portion having a plurality of the substantially horizontal base member 19 which extend between the respective legs 14 and 16. Following usual practice, a series of piles 21 are driven through the support legs and into the ocean floor 12 to stabilize the structure at its offshore site.

As mentioned herein an offshore structure 10 of this type is normally provided with an array of sacrificial anodes. The latter, although not specifically shown, are disposed both vertically and horizontally along the respective metallic legs 14 and 16, and support member 19. They are spaced and arranged to afford the maximum degree of cathodic protection.

Figure 2:
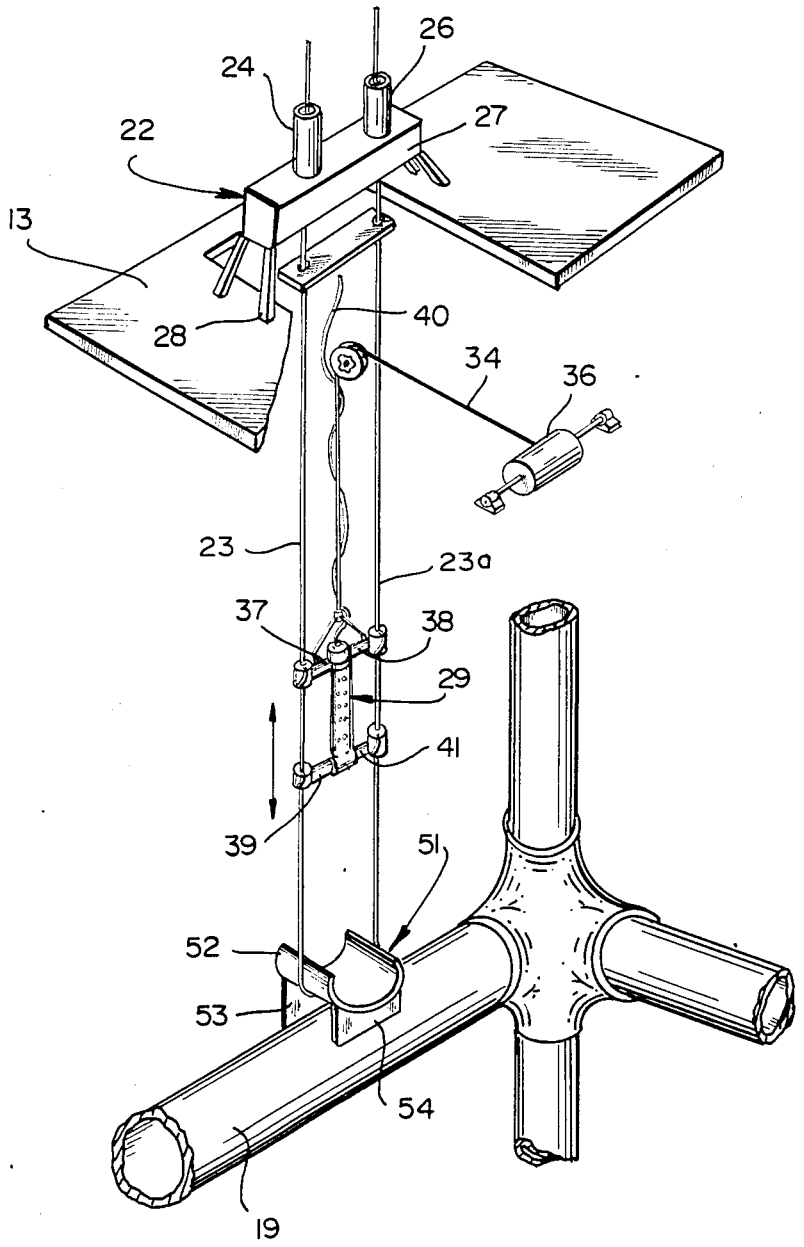
FIG. 2 is an expanded, segmentary view of the apparatus shown in FIG. 1.

Referring to FIG. 2, one embodiment of the present cathodic protection monitoring system is shown with portions of the structure's jacket removed. Thus, the upper end of the system includes a terminal member 22 which is supported on the structure's deck 13, or on an appropriate part of the jacket. Said terminal member is adapted to receive both ends of elongated guide cable segments 23 and 23*a* in tensioning elements 24 and 26. Thus, the cable ends can be held in place and appropriately adjusted and/or tensioned.

Terminal member 22 can comprise a number of different embodiments to achieve its purpose. In the present embodiment a central body 27 is supported by a series of legs 28, which in turn rest on deck 13. Body 27 is provided with means to provisionally receive the cables 23 and 23a.

Figure 3:
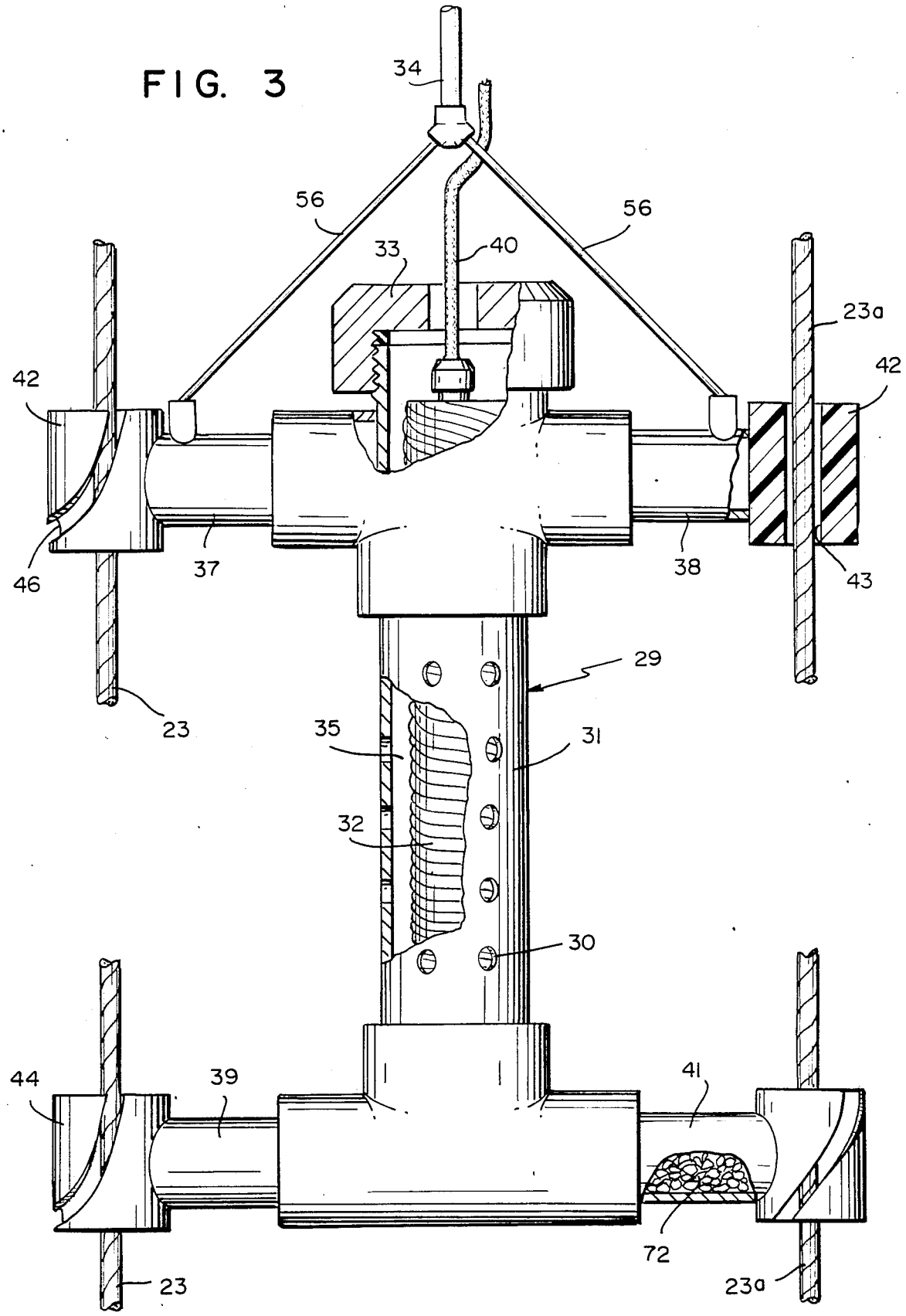
FIG. 3 is a segmentary view of the instrument-carrying package of FIG. 1.

Referring to FIG. 3, carriage 29 is comprised of elongated body 31 which defines an internal chamber 35 for removably receiving one or more reference cells 32. The walls of body 31 are perforated with openings 30 to allow access of sea water which then immerses the reference cell 32 during a monitoring operation providing electrical contact to the jacket structure via sea water.

The upper end of body 31 is provided with a removable cover 33 which furnishes a partial closure to the cell holding internal chamber 35. Thus, the one or more cells 32 can be inserted into or removed from the internal chamber 35 as required for use.

Cell 32 is normally furnished with electrical leads, and generated signals are conducted to deck positioned monitoring equipment by electrical conductor 40. Operationally, the one or more cells 32 are sufficiently sensitive, and function to measure the electrical potential existing between the cell, and adjacent metallic segments of the steel jacket members. A signal is thereby established in proportion to the measured potential.

Carriage 29 is further provided with upper guide or spacer arms 37 and 38 which depend outwardly from body 31. A corresponding set of guide arms 39 and 41, similarly engage the guide cable and extend outwardly from a lower portion of said body 31.

Spacer arms 37 and 38 can be provided with a suitable fitting to anchor a bridle 56 which engages the end of lifting cable 34. The latter functions to raise and lower carriage 29 thereby traversing a section of the jacket at a controlled speed to achieve the desired vertical scanning action.

Cable 34 engages a powered winch 36 on deck 13 for regulating the carriage's vertical position and movement. In a preferred embodiment, vertical movement of carriage 29 is assured without jamming through use of bridle 56 which includes two segments, each of which attaches to one of the guide arms 37 through 38 respectively, and through a common connection to cable 34.

Each guide arm, 37 for example, terminates at a contact shoe 42. The latter, in one embodiment, comprises a tubular member having an axial bore 43 which is aligned in a direction substantially parallel to elongated body 31.

Contact shoe 42 is disposed in vertial alignment with a corresponding shoe lower 44 and lies in a plane common to all four shoes. Functionally, the respective contact shoes 42 and 44 removably engage guide cables 23. With the four shoes concurrently engaged, carriage 29 can be caused to vertically scan a portion of the jacket along the cables 23 and 23a in response to operation of powered winch 36.

To facilitate the provisional use of carriage 29 along the jacket, or removal therefrom, each contact shoe such as 42, is provided with a helical slot 46 formed in the shoe outer wall. Slot 46 is of sufficient width to slidably register the guide cable thereon when either the cable, or the carriage is angularly adjusted to allow passage of cable 23 through said slot 46. Slot 46 thus extends diagonally along the shoe 42 wall thereby permitting sliding engagement with the cable, while allowing the latter to guide carriage 29 and regulate its disposition.

To assure a high degree of accuracy in monitor cell 32 readings, carriage 29 is fabricated to avoid its interfering with the scanning operation. Preferably, the carriage is fabricated of a non-electrical conducting, non-electrically shielding and non-corrosive material.

To this end, a preferred embodiment of carriage 29 can be fabricated of a preformed non-shielding rigid or semi-rigid, thermosetting plastic such as polyvinyl chloride. Thus, the assembled members, such as body 31, arms 37 and 38, as well as the contact shoes 42 at each arm extremity, can comprise prefabricated tubular elements which are slidably fitted and cemented together into a composite unit by a suitable adhesive.

Referring again to FIG. 2 the lower end of the platform jacket is provided on at least one lower base member 19, with a turning spool 51. The latter comprises basically an arcuate shaped shoe 52 which is formed to define a curved surface along which the elongated guide cable segments 23 and 23a are retained.

Turning shoe 52 as shown, is formed in one embodiment of a tubular member which has been fabricated to define a convex contact surface on which the guide cable is positioned.

Arcuate shoe 52 is carried on spaced apart positioning brackets 53 and 54 which depend downwardly from the shoe and are fixed in place on base member 19. Normally turning spool 51 is fabricated of steel and is thus subjected to the corrosive effects herein mentioned. However, this segment of the structure can be provided with coated surfaces as above mentioned or with sacrificial anodes to avoid or deter corrosion.

Elongated guide cable segments 23 and 23a as shown, extend from upper terminal member 22, downward to the turning spool 51, having both cable ends adjustably gripped at tension members 24 and 26. The tensioned guide cable thus defines a pair of spaced apart guide means upon which instrument-carrying carriage 29 can be slidably mounted to or disengaged from.

The upper ends of the respective guide cables can be readily adjusted such that a predetermined tension is applied to the respective guide cable segments 23 and 23a without exerting excessive stress on turning spool 31.

Over a period of time, the respective guide cables 23 and 23a will tend to acquire various forms of flora and fauna along its outer surface, the amount thereof is a function of the local environment. Should this marine growth go unchecked, it could eventually interfere with or prevent movement of the guide shoes therealong.

Therefore, in a further embodiment of the invention, two or more of the cable contacting guide shoes 42 can be provided with a scraper appendage capable of cleaning the cables of marine growth during a normal scanning function.

Figure 4:
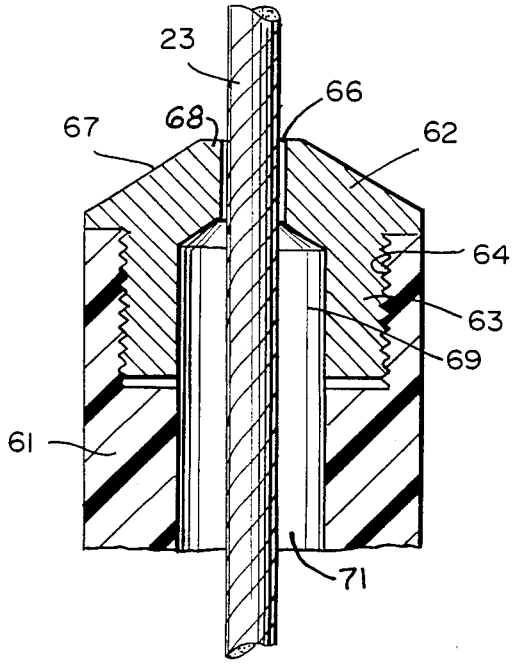
FIG. 4 is an alternate embodiment of the guide shoe.
Figure 5:
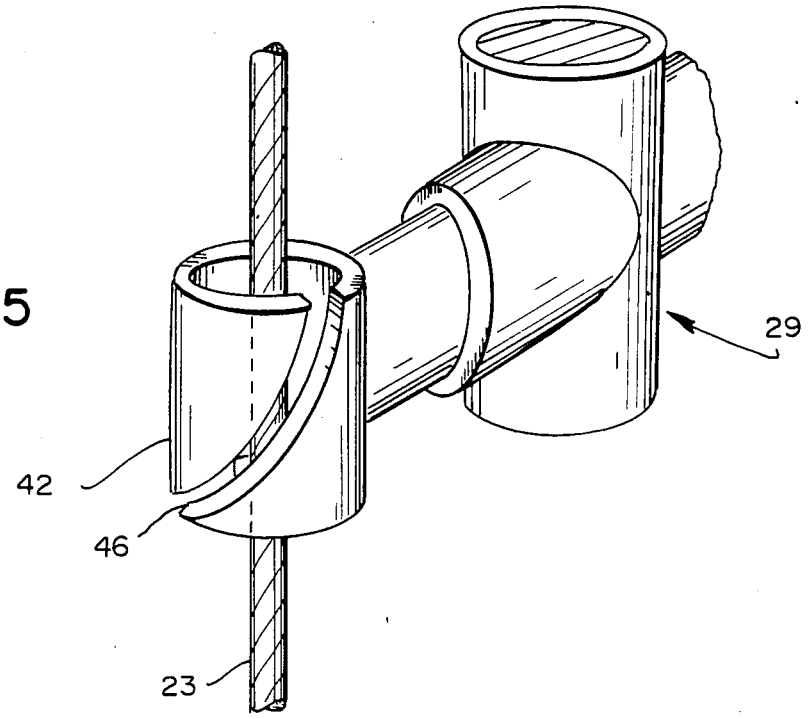
FIG. 5 is a segmentary side view of the apparatus shown in FIG. 3.

As shown in FIG. 4, the respective guide or contact shoes such as 61, are shaped to not only be guided along the cable 23 but also to scrape and substantially clean the cable's external surface.

Contact or guide shoe 61 includes an insert piece 62 which depends from one or both end faces of the shoe. Insert 62 comprises a member having a threaded shank 63 which engages a corresponding cavity 64 formed in the shoe end face.

Insert 62 can embody a central opening 66 which registers about cable 23. The insert forward edge 67 is conformed with a conical shape which terminates at a cutting lip 68.

Lip 68 is adapted to be urged against and to contact marine growth which has formed at the surface of cable 23 with the purpose of cutting and/or dislodging such growth. The insert, to best achieve this function, is formed of a suitable metal, such as steel or brass, to which the sharp cutting-lip 68 can be fashioned. In a preferred arrangement, the metallic insert 62 is threadably engaged with the cavity 64 of shoe 61, as shown, and abuts a peripheral shoulder 69 fully-seated inset cavity.

The insert axial opening 66 is further communicated with an expanded chamber 71 which allows cut debris to pass through shoe 61 as it is pulled along cable 23.

Shoe 61 can be provided with a side-wall slot as described herein, to permit the shoe to be removably registered about a guide cable.

Operationally, carriage 29 is removably equipped with means including necessary instrumentation, along with the one or more cells 32, to monitor the degree of corrosion which takes place on various metallic jacket members. This instrumentation, it is understood, includes sensing means to permit an accurate survey of the jacket, thus providing an electrical potential which is transmitted as a signal from carriage 29 through transmission cable 40 to a readout apparatus on deck 13.

To assure that carriage 29 will descend through a body of water, it can be provided with a form of ballast. The latter can include an amount of grout 72 or other weighty material which is carried in the respective tubular guide arms, and preferably in lower arms 39 and 41.

It is understood that although modifications and variations of the invention may be made without departing from the spirit and scope thereof, only such limitations should be imposed as are indicated in the appended claims.

We claim:

1. In a corrosion monitoring system for an offshore structure having a deck, an underwater deck supporting jacket formed of members which are subject to corrosion, said system including guide cable means (23–23*a*) which extend longitudinally of the jacket, a carriage (29) detachably engaging said guide cable means and adapted to be slidably positioned along the latter, signal generating corrosion sensing cell means (32) carried on said carriage (29) for communication with signal receiving means on said deck, control means (34) engaging said carriage (29) for operably regulating the longitudinal position thereof along said guide cable means (23–23*a*), said carriage (29) fabricated of a material capable of enclosing the corrosion sensing cell means (32) without interfering with the generation of signals by said cell means which reflect the corrosive condition of said jacket members, and comprising an elongated body (31), a plurality of lateral arms (37 and 38) extending outwardly from said elongated body (31) and including a contact shoe (42) at the remote end of said respective arms to removably engage said guide cable means (23, 23*a*), and said shoe (42) having a wall including a slotted opening (46) formed therein, said opening being of sufficient width to register said guide cable means (23) therethrough.

2. A system as defined in claim 1 wherein said

3. In a system as defined in claim 1 wherein the respective contact shoe (42) at each extremity of said plurality of arms which depend from said elongated body, lies in a common plane.

4. In the system as defined in claim 1 wherein said plurality of lateral arms which depend from said elongated body (31) extend from opposite sides of the latter and lie in a common plane.

5. In a system as defined in claim 4 wherein the contact shoes 42 at opposed sides of said elongated body (31) are disposed in substantial axial alignment for accommodating a guide cable means therethrough.

6. In the apparatus as defined in claim 1, wherein said contact shoes (61) include a contact face at either end thereof, an insert (62) received in at least one end of said shoe (61), having a central opening (66) of sufficient diameter to register closely about a cable (23), a lip (68) formed in said insert (62) at the edge of opening (66), being operable when said shoe (61) is moved along cable (23), to engage and dislodge marine growth which has accumulated on the cable's surface.

7. In the apparatus as defined in claim 1, wherein said insert (62) is removably engaged with the upper end of said shoe (61).

8. In the apparatus as defined in claim 1, wherein said shoe (61) is formed of a non-metallic material, and said insert (62) is formed of a metal.

9. In the apparatus as defined in claim 1, wherein said shoe (61) includes a longitudinal cavity (64) at the upper face thereof, and said insert (62) includes a shank (63) which is removably fastened in said longitudinal cavity (64).

* * * * *

UNITED STATES PATENT AND TRADEMARK OFFICE

CERTIFICATE OF CORRECTION

PATENT NO. : 4,690,587

DATED : September 1, 1987

INVENTOR(S) : Karl H. Petter and Gregory K. Robbins

It is certified that error appears in the above—identified patent and that said Letters Patent is hereby corrected as shown below:

Claim 2 should read in its entirety:

--2. A system as defined in Claim 1, wherein said slotted opening 46 defines a helical path through a wall of said contact shoe.--

Signed and Sealed this

Sixth Day of September, 1988

*Attest:*

DONALD J. QUIGG

*Attesting Officer*

*Commissioner of Patents and Trademarks*